US006542066B1

(12) United States Patent
Hasunuma et al.

(10) Patent No.: US 6,542,066 B1
(45) Date of Patent: Apr. 1, 2003

(54) ELECTRIC ASSEMBLY AND DEVICE

(75) Inventors: Takashi Hasunuma, Narita (JP); Mikio Iimura, Edosakimachi (JP); Katsuaki Suzuki, Ryugasaki (JP)

(73) Assignee: Tyco Electronics Raychem K.K., Kanagawa (JP)

( * ) Notice: Subject to any disclaimer, the term of this patent is extended or adjusted under 35 U.S.C. 154(b) by 0 days.

(21) Appl. No.: 09/509,745

(22) PCT Filed: Oct. 2, 1998

(86) PCT No.: PCT/JP98/04459

§ 371 (c)(1),
(2), (4) Date: Jun. 8, 2000

(87) PCT Pub. No.: WO99/18585

PCT Pub. Date: Apr. 15, 1999

(30) Foreign Application Priority Data

Oct. 3, 1997 (JP) ..... 9-271147

(51) Int. Cl.[7] ..... H01C 7/10

(52) U.S. Cl. ..... 338/22 R; 338/235; 338/260; 338/320; 338/239

(58) Field of Search ..... 338/22 R, 232, 338/235, 236, 237, 239, 260, 320

(56) References Cited

U.S. PATENT DOCUMENTS 3,750,082 A * 7/1973 Petersen et al. ..... 338/220
3,878,501 A * 4/1975 Moorhead et al. ..... 338/22 R
3,914,727 A * 10/1975 Fabricius ..... 338/22 R
4,395,623 A * 7/1983 Shimada et al. ..... 338/22 R
4,814,584 A * 3/1989 Bohlender et al. ..... 338/22 R
5,166,658 A * 11/1992 Fang et al. ..... 338/23
5,382,938 A * 1/1995 Hansson et al. ..... 338/22 R
5,777,541 A * 7/1998 Vekeman ..... 338/22 R
5,798,685 A * 8/1998 Katsuki et al. ..... 338/195
5,909,168 A * 6/1999 Miyasaka et al. ..... 338/22 R

FOREIGN PATENT DOCUMENTS

JP 6-120009 4/1994
JP 6-275370 9/1994

* cited by examiner

*Primary Examiner*—Karl D. Easthom

(57) ABSTRACT

An electrical device comprising a pair of electrodes, three substrates, and PTC elements inserted between the substrates, each PTC element having metal layers on both surfaces, in which each of the outer substrates has a metal layer on the inner surface, the two metal layers being electrically connected to one of the electrodes and in electrical contact with the respective metal layers of the PTC elements facing said metal layers of the outer substrates, and the center substrate has a metal layer on both surfaces, such metal layers being electrically connected to the other electrode and in electrical contact with the respective metal layers of the PTC elements facing said metal layers of the center substrate. This electrical device can increase the area of the PTC elements without increasing the projected area as a whole.

12 Claims, 2 Drawing Sheets

ELECTRIC ASSEMBLY AND DEVICE

FIELD OF THE INVENTION

The present invention is related to an electrical assembly and device. In particular, the present invention relates to an electrical assembly and device comprising an element exhibiting positive temperature coefficient behavior.

Since the electrical assembly or device of the present invention comprises a positive temperature coefficient element, it can be used in applications where conventional electrical assemblies or devices comprising a positive temperature coefficient element are used, for example, as a circuit protection device which is assembled in an electric circuit and breaks the circuit if an abnormal current passes through the circuit. Alternatively, the electrical assembly or device of the present invention can be assembled in a circuit to open a relay switch which is assembled in the circuit in series with a load, when a resistance increases.

PRIOR ART

Elements exhibiting positive temperature coefficient behavior (hereinafter called "positive temperature coefficient element" or "PTC element") generally have a characteristic that the resistivity increases in response to a temperature increase in a comparatively narrow temperature range, and can be used as, for example, a circuit-protection element.

Devices comprising PTC elements have no mechanical components, and when abnormal current passes through the circuit, the resistance increases to shut off the circuit. Thus, such devices are used as circuit protection devices.

In the case of circuit protection devices, it is desirable to make the resistance of the device as small as possible in order to increase the holding characteristic (the minimum current at which the device actuates). In order to decrease the resistance, it may be contemplated to decrease the thickness of the PTC element, or to increase the area of the PTC element.

There is a limit to decreasing the thickness of the PTC element, and devices currently used to protect circuits such as integrated circuits comprise PTC elements having a thickness close to the limit. If the area of the PTC element is increased, on the other hand, the area of the device is also inevitably increased. As integrated circuits become more highly integrated, the size of each element is required to be minimized and the area of the device cannot be increased beyond a certain level.

SUMMARY OF THE INVENTION

One object of the present invention is to provide an electrical assembly and device comprising a PTC element, where the area of the PTC element is increased without increasing the projected area as a whole.

Another object of the present invention is to provide a simple and economical method for producing such an electrical assembly and device.

The present invention provides the following electrical assembly, the electrical device and the method for producing the same:

[I] An electrical assembly comprising (1) a body member which (a) is composed of an electrically insulating material, and (b) includes at least two cavities;

(2) spaced-apart electrically conductive contact members, there being at least two contact members within each cavity;

(3) a plurality of electrical devices, each device being positioned in one of the cavities and each cavity having at least one device positioned therein; each device comprising spaced-apart electrically conductive terminals in physical and electrical contact with the contact members within the cavity in which the device is positioned; and at least one of the devices being a PTC device (including a bimetallic switch);

(4) a plurality of electrically conductive connection members which are secured to the body member, each contact member being in physical and electrical contact with at least one connection member; and (5) electrically conductive terminals through which the assembly can be electrically connected into a circuit, each terminal being (a) secured to the body member, and (b) in physical and electrical contact with at least one connection member;

the connection member being electrically connected to each other so that, when the terminals are connected into a circuit, at least two of the devices are connected in parallel.

[II] An electrical device comprising a pair of electrodes (terminal members), at least three substrates (constituting a body), and PTC elements inserted between the substrates (corresponding to the cavities of the body), each PTC element having metal layers (terminals) on both surfaces, wherein each of the two outermost substrates has a metal layer (conductive contact member) on the inner surface, the two metal layers (conductive contact members) being in electrical contact with the respective metal layers (terminals) of the PTC elements facing said metal layers of the outermost substrates, the other substrates have metal layers (conductive contact members) on both surfaces, such metal layers (conductive contact members) being in electrical contact with the respective metal layers (terminals) of the PTC elements facing said metal layers (conductive contact members)of the substrates, and all the PTC elements are connected in parallel with the electrodes (terminal members).

[III] An electrical device as described in [II], wherein the number of substrates is three, each of the outer substrates has a metal layer (conductive contact member) on the inner surface, the two metal layers (conductive contact members) being electrically connected to one of a pair of electrodes (terminal members) and in electrical contact with the respective metal layers (terminals) of the PTC elements facing said metal layers (conductive contact members) of the outer substrates, and the center substrate has a metal layer (conductive contact member) on both surfaces, such metal layers (conductive contact members) being electrically connected to the other electrode (terminal member) and in electrical contact with the respective metal layers (terminals) of the PTC elements facing said metal layers (conductive contact members) of the center substrate.

[IV] An electrical device as described in [III], wherein the three substrates are integrally bonded to one surface of a back plate, the metal layers (conductive contact members) on the inner surfaces of the two outer substrates are electrically connected by an electrode (conductive connection member) formed on the outer surfaces of said outer substrates and the outer surface of the back plate, and the metal layers (conductive contact members) formed on both surfaces of the center substrate are electrically connected by an electrode (conductive connection member) formed at least in a through-hole provided on the back plate and on the outer surface of the back plate.

[V] An electrical device as described in [III], wherein the three substrates are integrally connected to one surface of the back plate, the metal layer on the inner surface of one of the outer substrates is connected to an electrode formed on the outer surface of said substrate and the outer surface of the back plate, the metal layers on the inner surfaces of both end substrates are electrically connected to each other by a metal band formed on the inner surface of the back plate, and the metal layers formed on both surfaces of the center substrate are electrically connected by an electrode formed at least in a through-hole provided on the back plate and on the outer surface of the back plate.

[VI] A method for producing an electrical device as described in [IV], comprising the steps of:

integrally forming the back plate and the three substrates from a resin, forming metal layers on the inner surfaces of the outer substrates and on both surfaces of the center substrate, forming a first electrode, which is connected to the two metal layers on the inner surfaces of the outer substrates, on the outer surfaces of the outer substrates and the outer surface of the back plate, and forming a second electrode, which is connected to the metal layers on both surfaces of the center substrate, at least in the through-hole provided on the back plate and on the outer surface of the back-plate, and inserting positive temperature coefficient elements having metal layers on both surfaces between the substrates.

[VII] A method for producing simultaneously two switches as described in [V], comprising the steps of:

integrally forming the back plate and five substrates, forming metal layers on the inner surfaces of the outermost substrates and the both surfaces of other three substrates, forming a first electrode, which is connected to each of the metal layers on the inner surfaces of the outermost substrates, on the outer surfaces of the outermost substrates and the outer surface of the back plate, and forming a second electrode, which is connected to the metal layers on both surfaces of each of the intermediate substrates sandwiched between the outermost substrates and the center substrate, at least in the through-hole provided on the back plate and on the outer surface of the back plate, forming a metal band, which electrically connects each of the metal layers on the inner surfaces of the outermost substrates to a metal layer on either surface of the center substrate, on the inner surface of the back plate, inserting PTC elements having metal layers on both surfaces between the substrates, and cutting the center substrate in a direction perpendicular to the direction of the thickness.

DETAILED DESCRIPTION OF THE INVENTION

In one preferred embodiment of the electrical assembly of the present invention, at least one of the electrical devices comprises first and second planar electrodes and a polymer PTC element between the electrodes.

In another preferred embodiment of the electrical assembly of the present invention, each of the electrical devices comprises first and second planar electrodes and a polymer PTC element, and when the terminals are connected into a circuit, all the electrical devices are connected in parallel with each other.

In the electrical assembly of the present invention, when the terminals are on a planar surface of the body member, the assembly can be surface-mounted on a printed circuit board.

In a further preferred embodiment of the electrical assembly of the present invention, the connection members include a plated hole which passes through the body member.

In a yet further preferred embodiment of the electrical assembly of the present invention, the body member is a monolithic polymeric body and each of the cavities is open-ended.

Hereinafter, the electrical assembly or device of the present invention is explained by making reference to the drawings.

Figure 1:
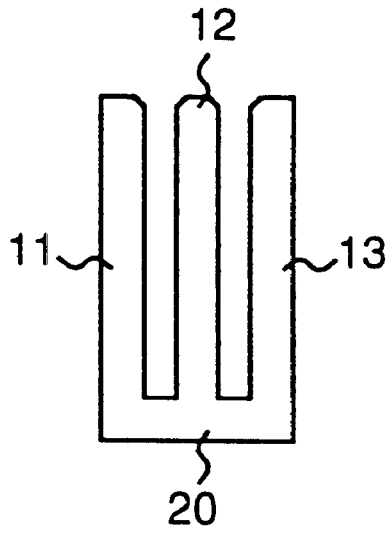
FIG. 1 is a front view of the first embodiment of the switch of the present invention.

FIG. 1 is the front view of one example of the substrates and back plate constituting the first embodiment of the electrical device of the present invention. The three substrates 11, 12, and 13 are integrally formed with the back plate 20. There are gaps between the substrates corresponding to the thickness of the PTC elements (positive temperature coefficient elements).

Figure 2:
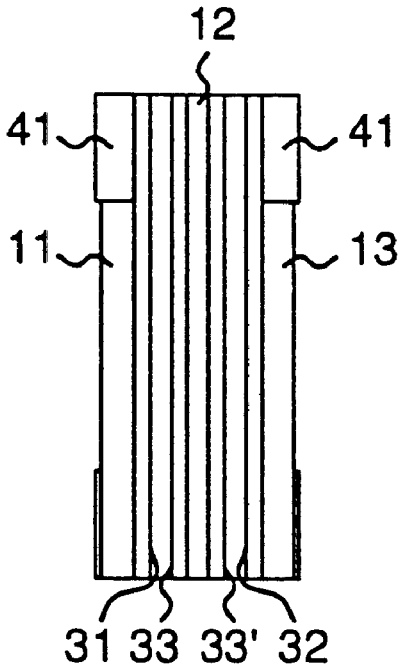
FIG. 2 is a plan view of the first embodiment of the switch of the present invention.

FIG. 2 is the plan view of the substrates. As shown in FIG. 2, metal layers 31 and 32 are formed on the inner surfaces, i.e. the surfaces facing the center substrate 12, of the two end substrates 11 and 13 respectively. Further, metal layers 33 and 33' are formed on the both surfaces of the center substrate 12.

Figure 3:
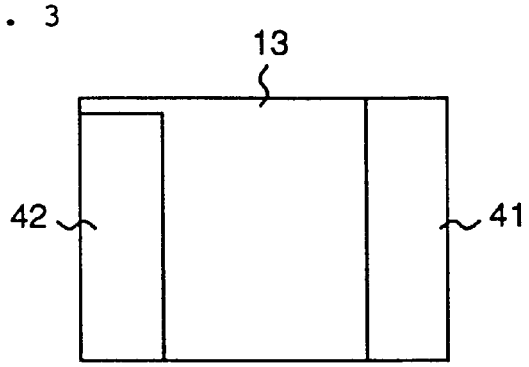
FIG. 3 is a side view of the first embodiment of the switch of the present invention.
Figure 4:
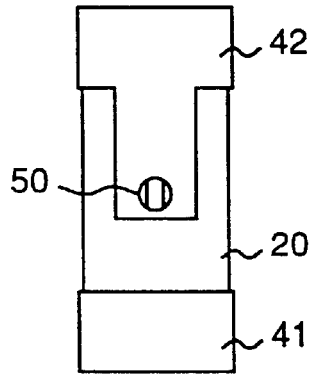
FIG. 4 is a bottom view of the first embodiment of the switch of the present invention.

An electrode 41 is formed on the outer surfaces and the top edge surfaces of the substrates 11 and 13 and on the back plate 20, as shown in FIG. 3 (the side view of the substrate 13 side), FIG. 2, and FIG. 4 (the bottom view). The electrode 41 is connected electrically to the metal layers 31 and 32 formed on the inner surfaces of the substrates 11 and 13.

At the same time, as shown in FIGS. 3 and 4, another electrode 42 is formed on the outer surfaces of the substrates 11 and 13 and on the back plate 20. The electrode 42 is connected electrically via a through-hole 50 to the metal layers 33 and 33' formed on both surfaces of the center substrate 12.

When PTC elements having metal layers on both surfaces (not shown) are inserted between the substrates, the metal layers of the two PTC elements come in contact with the metal layers 31 and 33, and the metal layers 32 and 33' respectively, to complete the electrical device of the present invention.

In the electrical device having such a construction, the two PTC elements are connected in parallel with the electrodes, so that the area of the PTC element is doubled and the resistance of the electrical device as a whole is halved. As a result, the holding characteristic is increased about 1.4 times.

In the second embodiment of the electrical device of the present invention, the metal layer on the inner surface of one of the end substrates is connected to the electrode formed on the outer surfaces of the substrates and outer surface of the back plate, and the metal layers on the inner surfaces of the end substrates are electrically connected to each other by the electrode formed on the inner surface of the back plate. This embodiment is explained by making reference to the drawing.

Figure 5:
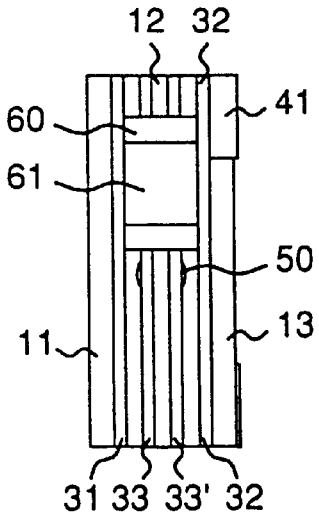
FIG. 5 is a plan view of the second embodiment of the switch of the present invention

FIG. 5 is a plan view of the substrates and back plate of the second embodiment.

A section of the center substrate 12 is removed and a groove 60 is formed on the corresponding inner surface of the back plate. A metal band 61 is provided in the groove 60 and electrically connects the metal layers 31 and 32 formed on the inner surfaces of the substrates 11 and 13.

In the second embodiment, the electrodes 41 and 42, which are provided on the outer surfaces and the top edge surfaces of the substrates 11 and 13 in the first embodiment, become unnecessary on one of the substrates (substrate 11 in FIG. 5), while the electrode 41 provided on the outer side and the top edge surface of the other substrate and the electrode 42 on the back plate are needed for electrical connection with the circuit. Therefore, the bottom view of this embodiment of the electrical device is substantially the same as FIG. 4.

Next, the method of producing the electrical device of the present invention is explained.

The electrical device of the present invention is preferably produced by the MID (Molded Interconnect Device) method. The MID method is a fabrication method wherein circuits and/or electrodes are formed by plating directly on resin substrates formed for instance by injection molding and is carried out, for example, in the following steps:

The surface of the formed substrate is etched and then treated with a catalyst, after which the entire surface is electroless plated with copper.

Next, predetermined sections are masked with a resist and electroplated, and then the resist is removed, followed by copper etching.

The substrates and back plate of the electrical device of the present invention are integrally formed from an engineering plastic, preferably a liquid crystal polymer.

In the case of the electrical device shown in FIGS. 1 through 4, the metal layers and electrodes are formed as follows:

Metal layers 31, 32, 33 and 33' are formed by plating on the inner surfaces of the outer substrates 11 and 13, and on both surfaces of the center substrate 12 respectively. Also, the first electrode 41, which is connected to the two metal layers 31 and 32 on the inner surfaces of the outer substrates, is formed on the outer surfaces of the outer substrates 11 and 13 and the outer surface of the back plate 20, and the second electrode 42, which is connected to the metal layers 33 and 33' on the both surfaces of the center substrate 12, is formed by plating on at least the outer surface of the back plate 20, preferably on the outer surface of the back plate 20 and the outer surfaces of the outer substrates 11 and 13. The second electrode 42 is preferably connected electrically to the metal layers 33 and 33' via the through-hole 50 provided on the back plate 20.

Next, PTC elements having metal layers on both surfaces (not shown) are inserted between each pair of the substrates.

The thicknesses of the metal layers and the electrodes are not restricted as long as sufficient conductivity is obtained, but are usually from 15 to 45 $\mu$m and preferably from 25 to 35 $\mu$m.

In a more preferred method, a pair of electrical devices each having the structure as shown in FIG. 5 are produced.

That is, the back plate 20 is integrally formed with a total of five substrates consisting of the center substrate having twice the thickness of substrate 11, the two intermediate substrates 12 on either side of the center substrate, and the two outermost substrates 13. Each of the intermediate substrates 12 is cut away in an appropriate section (see FIG. 5).

Metal layers are formed by plating on the inner surfaces of the outermost substrates 13 and both surfaces of the remaining three substrates.

The first electrode 41, which is connected to each of the metal layers 32 on the inner surfaces of the outermost substrates 13, is formed on the outer surfaces of the outermost substrates 13 and the outer surface of the back plate 20, and the second electrode 42, which is connected to the metal layers 33 and 33' on the both surfaces of each of the intermediate substrates 12 sandwiched between the outermost substrates 13 and the center substrate, is formed by plating on the outer surface of the back plate 20 and the outer surfaces of the outermost substrates 13. In this embodiment also, the second electrode 42 is preferably connected electrically to the metal layers 33 and 331 via the through-hole 50 provided on the back plate 20.

At the same time, the metal band 61, which electrically connects each of the metal layers 32 on the inner surfaces of the outermost substrates 13 to the corresponding metal layer 31 on the surfaces of the center substrate, is formed by plating inside the groove 60 formed on the inner surface of the back plate.

PTC elements having metal layers on both surfaces are inserted between the substrates, and finally the center substrate 11 is cut in a direction perpendicular to the direction of the thickness to complete the electrical devices of the present invention.

The thickness of the center substrate is required only to be at least twice the thickness of the substrate 11 in the finished switch.

The electrical device of the present invention with two PTC elements has been explained. The number of the PTC elements may be increased to three or more as required, in which case the number of substrates are increased correspondingly and the design of the electrodes are modified so that all the PTC elements are connected in parallel.

What is claimed is:

1. An electrical device comprising (1) a pair of electrodes;

(2) three substrates which are integrally bonded to one inner surface of a back plate, the two outermost substrates having a metal layer on an inner surface, and the center substrate having metal layers on both surfaces; and (3) PTC elements (a) inserted between the substrates, (b) each PTC element having metal layers on both surfaces, one metal layer of each PTC element facing and in electrical contact with the inner metal layers of an adjacent outermost substrate and a second metal layer of each PTC element facing and in electrical contact with a metal layer of the center substrate, and (c) all being connected in parallel with the electrodes;

the metal layers on the inner surfaces of the two outer substrates being electrically connected by an electrode formed on the outer surfaces of said outer substrates and the outer surface of the back plate, and the metal layers formed on both surfaces of the center substrate being electrically connected by an electrode formed at least in a through-hole provided on the back plate and on the outer surface of the back plate.

2. A device according to claim 1 wherein the center substrate has a thickness that is at least twice the thickness of the outermost substrates.

3. A device according to claim 1 wherein the metal band is formed in a groove formed on the inner surface of the back plate.

4. A device according to claim 1 wherein the substrates and the back plate are formed from an engineering plastic.

5. A device according to claim 4 wherein the engineering plastic is a liquid crystal polymer.

6. A device according to claim 1 which is a circuit protection device.

7. A device according to claim 1 wherein the PTC elements are polymer PTC elements.

8. An electrical device comprising (1) a pair of electrodes;

(2) three substrates which are integrally bonded to one inner surface of a back plate, the two outermost substrates having a metal layer on an inner surface, and the center substrate having metal layers on both surfaces; and (3) PTC elements (a) inserted between the substrates, (b) each PTC element having metal layers on both surfaces, one metal layer of each PTC element facing and in electrical contact with the inner metal layers of an adjacent outermost substrate and a second metal layer of each PTC element facing and in electrical contact with a metal layer of the center substrate, and (c) all being connected in parallel with the electrodes;

the metal layer on the inner surface of one of the outer substrates being connected to an electrode formed on the outer surface of said substrate and the outer surface of the back plate, the metal layers on the inner surfaces of both outer substrates being electrically connected to each other by a metal band formed on the inner surface of the back plate, and the metal layers formed on both surfaces of the center substrate being electrically connected by an electrode formed at least in a through-hole provided on the back plate and on the outer surface of the back plate.

9. A device according to claim 8 wherein the substrates and the back plate are formed from an engineering plastic.

10. A device according to claim 8 wherein the engineering plastic is a liquid crystal polymer.

11. A device according to claim 8 which is a circuit protection device.

12. A device according to claim 8 wherein the PTC elements are polymer PTC elements.

* * * * *